United States Patent [19]

Mitchell et al.

[11] Patent Number: 4,708,888

[45] Date of Patent: Nov. 24, 1987

[54] COATING METAL MESH

[75] Inventors: Thomas A. Mitchell, Mentor; John E. Bennett; Claude M. Brown, both of Painesville; Gerald R. Pohto, Mentor, all of Ohio

[73] Assignee: ELTECH Systems Corporation, Chardon, Ohio

[21] Appl. No.: 855,551

[22] Filed: Apr. 29, 1986

Related U.S. Application Data

[63] Continuation-in-part of Ser. No. 731,420, May 7, 1985, abandoned.

[51] Int. Cl.[4] ..... C23F 13/00

[52] U.S. Cl. ..... 427/126.1; 204/196; 204/284; 204/290 F; 427/123; 427/126.5; 427/178

[58] Field of Search ..... 204/147, 148, 196, 197, 204/284, 290 F; 427/178, 123, 126.1, 126.5

[56] References Cited

U.S. PATENT DOCUMENTS

| | | | |
|---|---|---|---|
| 1,312,716 | 8/1919 | Wise | 427/178 |
| 2,916,429 | 12/1959 | Vossnack et al. | 204/197 |
| 2,978,098 | 4/1961 | Post | 427/178 |
| 3,034,923 | 5/1962 | Bowers | 427/178 |
| 3,265,526 | 8/1966 | Beer | 117/50 |
| 3,356,528 | 12/1967 | Gibson et al. | 427/178 |
| 3,408,235 | 10/1968 | Berghout et al. | 427/178 |
| 3,632,498 | 1/1972 | Beer | 204/290 |
| 3,671,415 | 6/1972 | King et al. | 204/284 |
| 3,711,385 | 1/1973 | Beer | 204/59 |
| 3,981,790 | 9/1976 | Olson et al. | 204/286 |
| 4,097,346 | 6/1978 | Robertson | 204/80 |
| 4,097,347 | 6/1978 | Packer | 204/109 |
| 4,187,164 | 2/1980 | Warne | 204/147 |
| 4,292,149 | 9/1981 | Warne | 204/147 |
| 4,415,411 | 11/1983 | Kanai et al. | 204/29 |
| 4,460,441 | 7/1984 | Domning | 204/73 |
| 4,502,929 | 3/1985 | Stewart et al. | 204/196 |
| 4,519,886 | 5/1985 | de Nora et al. | 204/196 |
| 4,519,888 | 5/1985 | Akazawa et al. | 204/252 |
| 4,528,084 | 7/1985 | Beer et al. | 204/290 |

FOREIGN PATENT DOCUMENTS

| | | |
|---|---|---|
| 0147977 | 7/1985 | European Pat. Off. . |
| 57-145992 | 9/1982 | Japan . |
| 896912 | 5/1962 | United Kingdom . |
| 2140456 | 11/1984 | United Kingdom . |
| 240561 | 10/1985 | United Kingdom . |

OTHER PUBLICATIONS

Niles Expanded Metals Catalog, p. 12, (1973).

"Platinized Anode in Carbonaceous Backfill—An Evaluation, T. H. Lewis, Jr., P. E., Paper No. 194, Corrosion/79.

International Search Report, European Patent Office, International Application No. PCT/US86/00932.

Patent Abstracts of Japan, vol. 7, 191(c-182) (1336), 8/83 & JP, A, 5891178, 5/83.

*Primary Examiner*—T. Tung

*Attorney, Agent, or Firm*—John J. Freer

[57] ABSTRACT

Coiled valve metal mesh of great void fraction and lengthy dimension and having a continuum of interconnected metal strands is coated with an electrocatalytic coating from liquid composition. The coating operation proceeds by contacting the mesh with liquid coating composition while the mesh is maintained in coiled form. This highly efficient coating method is continued through a curing operation while further maintaining the coated mesh in coiled form. Pretreatment preceding coating operation, e.g., degreasing and etching, may also be accomplished without uncoiling of the mesh. The coated mesh can later be uncoiled and current distributors welded to it for use as an electrode, e.g., in cathodic protection.

16 Claims, No Drawings

COATING METAL MESH

CROSS-REFERENCE TO RELATED APPLICATION

This application is a continuation-in-part of previously filed U.S. patent application Serial No. 731,420 filed May 7, 1985 and abandoned.

BACKGROUND OF THE INVENTION

The most important development in electrolysis electrodes in recent years has been the advent of dimensionally stable electrodes following the teachings of U.S. Pat. Nos. 3,711,385 and 3,632,498. These dimensionally stable electrodes consist of a base or substrate of a valve metal, typically titanium, carrying an electrocatalytic coating such as a mixed oxide of platinum group metal and a valve metal forming a mixed crystal or solid solution. Many different coating formulations have been proposed.

The major use of these dimensionally stable electrodes has been as anodes in chlor-alkali production in mercury cells, diaphragm cells and more recently in membrane cells. Other uses have been as oxygen-evolving anodes for metal electrowinning processes, for hypochlorite and chlorate production, as metal plating anodes and so on. Use as an anode in cathodic protection has also been proposed and as cathodes in certain processes.

Depending on the use, these dimensionally stable valve metal electrodes have been proposed with various configurations such as rods, tubes, plates and complex structures such as an array of rods or blades mounted on a supporting current conducting assembly as well as a mesh of expanded valve metal typically having diamond shaped voids and mounted on a supporting current conducting assembly which provides the necessary rigidity.

Electrodes in the form of platinized valve metal wire are known for cathodic protection, but in practically every other application rigidity and close tolerances of the electrode are critical factors for successful operation. For example, many electrolytic cells are operated with an inter-electrode gap of only a few millimeters and the flatness and rigidity of the operative electrode face are extremely important.

For most applications, the dimensionally stable electrodes operate at relatively high current densities, typically 3–5 $KA/m^2$ for membrane cells, 1–3 $KA/m^2$ for diaphragm cells and 6–10 $KA/m^2$ for mercury cells. These high current densities, combined with the requirements of planarity/rigidity, necessitate valve metal structures of substantial current carrying capacity and strength.

Typical known valve metal electrodes of the type with expanded titanium mesh as operative face use a mesh having an expansion factor of 1.5 to 4 times providing a void fraction of about 30 to 70 percent. Such titanium sheets may be slightly flexible during the manufacturing processes but the inherent elasticity of the sheet is restrained, e.g. by welding it to a current conductive structure, typically having one or more braces extending parallel to the SWD dimension of the diamond-shaped openings. Such electrode sheets typically have a current-carrying capacity of 2–10 $KA/m^2$ of the electrode surface.

Other electrode configurations are known for special purposes, e.g., a rigid cylindrical valve metal sheet mounted in a linear type of anode structure for cathodic protection (see U.S. Patent No. 4,515,886). These known electrodes also have limited dimensions, for example an operative surface area not greatly exceeding 1 $m^2$ depending on the type of cell in which the electrode is to be used.

Manufacture of the known electrodes usually involves assembly of the electrode valve metal structure precisely on the desired dimensions, e.g, by welding, followed by surface treatment such as degreasing/etching/sandblasting and application of the electrocatalytic coating by various methods including chemi-deposition, electroplating and plasma spraying. Chemi-deposition may involve the application of a coating solution to the electrode structure by dipping or spraying, followed by baking usually in an oxidizing atmosphere such as air.

SUMMARY OF THE INVENTION

In a broad aspect, the present invention pertains to a method of manufacturing an electrode for electrochemical processes, of the type comprising a valve metal mesh provided with a pattern of substantially diamond shaped voids having LWD and SWD dimensions for units of the pattern, the pattern of voids being defined by a continuum of thin valve metal strands interconnected at nodes and carrying on their surface an electrocatalytic coating, with the method comprising: (a) providing a flexible, coiled valve metal mesh of thickness less than 0.125 cm having a void fraction of at least 80 percent, such mesh being elongated along the direction of the SWD dimension of the pattern and being coiled about an axis along the direction of the LWD dimension of the pattern, and (b) applying an electrocatalytic coating to the surface of the valve metal mesh while same is coiled to provide a flexible coated mesh electrode in coiled configuration, the mesh being uncoilable from the coiled configuration for use as an electrode.

The valve metal mesh can be preferably manufactured by processing a solid coil or sheet of metal through an expander. Suitable mesh can be obtained when such sheet or coil is expanded by a factor of at least 10:1. It is however contemplated that alternative meshes to expanded metal meshes may be serviceable. For such alternatives, thin metal ribbons can be corrugated and individual cells, such as honeycomb shaped cells can be resistance welded together from the ribbons. Slitters or corrugating apparatus could be useful in preparing the metal ribbons and automatic resistance welding could be utilized to prepare the large void fraction mesh.

The coated valve metal mesh electrode can have a valve metal current distributor member welded to the mesh, such as before and/or after uncoiling a roll of mesh. The current distributor may have electrocatalytic coating and be welded to mesh nodes, whereby it can extend along the LWD dimension of the mesh pattern. Thus in another aspect the present invention is directed to the resulting coated mesh articles in coiled or uncoiled form, including such coated mesh articles which form a portion of an assembly in combination with additional elements.

The coated metal mesh can serve for cathodic protection of steel reinforced concrete. It may also be similarly serviceable in direct earth burial cathodic protection. Generally, it may be utilized in any operation wherein the electrocatalytic coating on a valve metal substrate will be useful and wherein current density operating conditions up to 10 amps per square meter of mesh area are contemplated. It is advantageous if the coated metal mesh is in coiled form, as for rolling out of an electrode to be incorporated in a cathodic protection system as discussed in the U.S. patent application Ser. No. 855,549, which system is preferably installed as discussed in the U.S. patent application Serial No. 855,550. The teachings of these foregoing applications is herein incorporated by reference.

By means of the present invention, there has been found a fast and economical coating technique for coiled mesh of even greatly extended length. Such technique can achieve highly suitable coating results without deleterious strand breakage even for the more delicate meshes of greatly expanded valve metal and which have extremely great void volume. Compared to prior art techniques for producing coated valve metal electrodes, considerably greater electrode areas, for instance about 100 or even 200 square meters or even greater electrode surface areas, can be coated as a continuous expanse. Moreover, the economical coating operation of the present invention can be undertaken and completed with equipment that typically will be readily available in existing facilities having conventional coating apparatus.

DESCRIPTION OF THE PREFERRED EMBODIMENTS

The greatly expanded valve metal mesh processed by the method of the present invention includes such mesh as expanded from a thin sheet or coil of valve metal stock into mesh form. For producing such highly expanded mesh an expansion factor of at least 10:1 from the original stock will be used. The resulting mesh, by being expanded from a single sheet or coil precursor, will be a single continuum of thin metal strands connected at nodes. That is, separate individual strands will not have been brought together, but rather formed in the expansion operation whereby a thoroughly integrated mesh is prepared which can not be disassembled without either strand or node breakage, or both. This single, integrated continuum of strands and nodes from each expanded sheet or coil will form a pattern of repeating units in the mesh, e.g., substantially diamond-shaped units. Such a mesh is highly flexible and when made from stock of lengthy dimension, especially from valve metal in coil form, will most always lead after the expansion operation to mesh in coiled form. A more detailed discussion of representative and suitable metal mesh and its preparation will be presented hereinafter following a discussion immediately below of coating considerations for the present invention.

The coiled metal mesh before electrocatalytic coating operation may proceed through one or more of various pretreatment procedures. Such procedures may be simplistic, for example a simple rinse operation. Not infrequently the mesh may have, e.g., as by being imparted from the expansion operation, oils or other surface contamination. Therefore, a suitable pretreatment technique will often include a solvent degreasing operation. This can most always be accomplished with typical halocarbon solvent such as the chlorinated and/or fluorinated solvents as represented by chlorotrifluoromethane, methylene chloride and perchloroethylene. Other pretreatments for the coiled metal mesh may include the further typical techniques such as pickling and etching, as well as dry honing, i.e., sand blasting. In dry honing, a gritty and very finely divided, hard particulate can be blasted at the coiled mesh at high velocity. In a representative etching operation most usually an aqueous solution of inorganic acid will be used to contact the metal mesh as by spray or dip contact. Generally a strong inorganic acid aqueous solution, e.g., hydrochloric acid at a strength of up to about 30 percent concentration or more, can be utilized. It is also contemplated that combination pretreatment techniques may be employed. Such combination operations can include not only those where two different steps for a single operation are useful, e.g., a combination of spray and dip technique for degreasing, but also a combination such as a washing or rinsing action combined with mild abrasive treatment. Where several pretreatment operations are employed, for example degreasing and etching, intermediate steps between each operation may be used, such as drying and/or rinsing steps and the like.

It will be most suitable to pretreat the valve metal mesh from typical expansion operation by first degreasing, as in a commercial degreaser containing a boiling halocarbon solvent, e.g., perchloroethylene and then follow the degreasing by etching. This etching may include contact with an aqueous, concentrated hydrochloric acid solution, as by dip coating contact for a time up to about 20 minutes. A contact time of greater than about 20 minutes can lead to deleterious loss of metal in the etching operation. Usually the coiled metal mesh will be dipped into the etching solution for a time of at least about 5 minutes to provide sufficient metal surface roughness for enhanced coating adhesion and distribution. The useful concentrated hydrochloric acid solutions can contain acid in an amount within the range from about 5 to about 30 percent.

The liquid coating composition used in the method of the present invention will be such an electrochemically active coating as can be useful when applied as a lightweight coating. This lightweight coating, or "low loading" coating will often be at a coating weight of less than about 0.5 gram of platinum group metal per square meter of the metal mesh substrate. On the other hand some coatings will be useful when present in an amount of as little as about 0.05 gram of platinum metal per square meter of a metal mesh substrate. As representative of the electrochemically active coatings are those provided from platinum or other platinum group metals or they can be represented by active oxide coatings such as platinum group metal oxides, magnetite, ferrite, cobalt spinel or mixed metal oxide coatings. Such coatings have typically been developed for use as anode coatings in the industrial electrochemical industry. Suitable coatings of this type have been generally described in one or more of the U.S. Pat. Nos. 3,265,526, 3,632,498, 3,711,385 and 4,528,084. The mixed metal oxide coatings can often include at least one oxide of a valve metal with an oxide of a platinum group metal including platinum, palladium, rhodium, iridium and ruthenium or mixtures of themselves and with other metals. It is preferred for economy that the low load electrocatalytic coatings be such as have been disclosed in the U.S. Pat. No. 4,528,084.

It is contemplated that coatings will be applied to the coiled metal mesh by any of those means which are useful for applying a liquid coating composition to a metal substrate. Such methods include dip spin and dip drain techniques. Moreover spray application and combination techniques, e.g., dip drain with spray application can be utilized. With the above-mentioned coating compositions for providing an electrochemically active coating, a modified dip drain operation of the coiled metal mesh will be most serviceable. In this operation, the coil will be dipped into a bath of coating composition in a manner whereby the axis through the hollow center of the coil is at least substantially parallel to the surface of the liquid coating composition. The coil can be partly immersed or completely submersed in the coating composition. During contact it is then preferred to rotate the coil around its central axis to provide for thorough and even distribution of the liquid coating composition on the metal substrate. Particularly where large rolls of coiled metal are coated, this technique is preferable as only partial immersion of the coil in the coating solution is needed, with the subsequent rolling operation providing for thorough wetting out of the coating composition on the mesh substrate. To enhance such coating operation, the coil may be immersed and rotated, withdrawn from the coating composition bath, and then reimmersed and rotated, or counterrotated, with such operation being repeated to thoroughly coat the coiled mesh. In alternative processing, the hollow center of the coil can be vertical and the coil hung in this manner is then either partially or completely dipped, i.e., up to total coil immersion, in the coating composition. Following any of the foregoing coating procedures, upon removal from the liquid coating composition, the wet coil may simply dip drain or be subjected to other post coating technique such as forced air drying.

Typical curing conditions for the electrocatalytic coating can include cure temperatures of from about 300° C. up to about 600° C. Curing times may vary from only a few minutes for each coating layer up to an hour or more, e.g., a longer cure time after several coating layers have been applied. The curing operation can be any of those that may be used for curing a coating on a metal substrate. Thus, oven curing, including conveyor ovens may be utilized. Moreover, infrared cure techniques can be useful. Preferably for most economical curing, oven curing is used and the cure temperature used will be within the range of from about 450° C. to about 550° C. At such temperatures, curing times of only a few minutes, e.g., from about 3 to 10 minutes, will most always be used for each applied coating layer.

The metals of the coiled valve metal mesh will most always be titanium, tantalum, zirconium and niobium. As well as the elemental metals themselves, the suitable metals of the mesh can include metal alloys and intermetallic mixtures. Of particular interest for its ruggedness, corrosion resistance and availability is titanium. When considering the expansion of the mesh from a metal sheet, the useful metal of the sheet will most always be an annealed metal. As representative of such serviceable annealed metals is Grade I titanium, an annealed titanium of low embrittlement. Such feature of low embrittlement is necessary where the mesh is to be prepared by expansion of a metal sheet, since such sheet should have an elongation of greater than 20 percent. This would be an elongation as determined at normal temperature, e.g., 20° C., and is the percentage elongation as determined in a two-inch (5 cm.) sheet of greater than 0.025 inch (0.0635 cm.) thickness. Metals for expansion having an elongation of less than 20 percent will be too brittle to insure suitable expansion to useful mesh without deleterious strand breakage. Also with regard to the useful metals, annealing may be critical as for example with the metal tantalum where an annealed sheet can be expected to have an elongation on the order of 37 to 40 percent, which metal in unannealed form may be completely useless for preparing the metal mesh by having an elongation on the order of only 3 to 5 percent. Moreover, alloying may add to the embrittlement of an elemental metal and thus suitable alloys may have to be carefully selected.

The valve metal mesh can then be prepared directly from the selected metal by expansion from a sheet or coil of the valve metal. This will be a flexible sheet or coil. By being flexible it is meant that the sheet, or coil in uncoiled form, can be readily rolled into coil form. However the entire coil can be expected to be substantially dimensionally stable under normal conditions of handling and storage. Thus, in addition to being stretchable and readily bendable, the thin sheet will be readily coilable. By the metal expansion technique, a mesh of interconnected valve metal strands results. Typically where care has been chosen in selecting a metal of appropriate elongation, a highly serviceable mesh will be prepared using such expansion technique with no broken strands being present. Where the mesh is expanded from the metal sheet, the interconnected metal strands will have a thickness dimension corresponding to the thickness of the initial planar sheet or coil. Usually this thickness will be within the range of from about 0.05 centimeter to about 0.125 centimeter. Use of a sheet having a thickness of less than about 0.05 centimeter, in an expansion operation, can lead to a deleterious number of broken strands and can produce a mesh which is extremely floppy and when rolled into coils tends to sag, causing problems in handling and storage, e.g., leads to entanglement of adjacent rolls in storage. For economy, sheets of greater than about 0.12.5 centimeter are avoided.

The mesh can then be produced by expanding a sheet or coil of metal of appropriate thickness by an expansion factor of at least 10 times. Useful mesh can also be prepared where a metal sheet has been expanded by a factor up to 30 times its original area. Even for an annealed valve metal of elongation greater than 20 percent, an expansion factor of greater than 30:1 may lead to the preparation of a mesh exhibiting strand breakage. On the other hand, an expansion factor of less than about 10:1 may uneconomically leave additional metal. Preferably for economy the mesh will have been expanded by a factor within the range of from about 15:1 to about 25:1. Further in this regard, the resulting expanded mesh should have an at least 80 percent void fraction for ease of handling. Most preferably, the expanded metal mesh will have a void fraction of at least about 90 percent, and may be as great as 92 to 96 percent or more, while still supplying sufficient metal for a desired use, such as cathodic protection of steel reinforced concrete. Within the expansion factor range as discussed hereinbefore, the metal strands will be provided in a network of strands most always interconnected by from about 500 to about 2000 nodes per square meter of the mesh.

It can be expected that strands will have width dimensions of from about 0.05 centimeter to about 0.20 centimeter. For the special application to cathodic protection in concrete, it is expected that the total surface area of interconnected metal, i.e., including the total surface area of strands plus nodes, will provide between about 10 percent up to about 50 percent of the area covered by the metal mesh. Since this surface area is the total area, as for example contributed by all four faces of a strand of square cross-section, it will be appreciated that even at a 90 percent void fraction such mesh can have a much greater than 10 percent mesh surface area. This area will usually be referred to herein as the "surface area of the metal" or the "metal surface area". In such greatly expanded metal mesh it is most typical that the gap patterns in the mesh will be formed as substantially diamond-shaped apertures. Such "diamond-pattern" will feature apertures having a long way of design (LWD) from about 4 centimeters up to about 9 centimeters, although a longer LWD is contemplated, and a short way of design (SWD) of from about 2 to about 4 centimeters. The area within the diamond may be referred to herein as the "diamond aperture". It is the area having the LWD and SWD dimensions. For convenience, it may also be referred to herein as the "void", or referred to herein as the "void fraction" when based upon such area plus the area of the metal around the void. The shape discussed herein is "substantially diamond shaped", and by this it is to be understood that many other similar shapes can be serviceable to achieve the extremely great void fraction, e.g., scallop-shaped or hexagonal.

In utilizing the coiled mesh it will often be desirable to affix additional metal members to the mesh, such as after coating. For example, metal current distributor members can be metallurgically bonded to the coated coil. Attachment of additional metal members can occur following the coating operation. Although various metallurgical bonding techniques for assembling the coated roll with additional metal elements are contemplated, it has been found that electrical resistance welding can be efficiently employed. Thus, where the additional metal elements include current distribution members, these can be utilized as strips applied to the unrolled mesh and the strips can be spot welded across the mesh at the nodes. Furthermore, in such an assembly the current distributor members can have the low loading of electrocatalytic coating. Electrical resistance welding can be successfully employed to prepare these coated metal assemblies even where the metals for welding in face-to-face contact will each be coated faces.

It has also been found that the coils of greatly expanded mesh, although being lightweight, are nevertheless difficult to handle since sharp mesh edges can make manual handling hazardous. The method of the present invention is thus particularly suitable for reducing injury in the manual handling operations associated with the coiled mesh. For facilitating the manual handling ease of the mesh, as when a coil is placed into or removed from storage or when proceeding to subsequent operation, such as assembling with other elements, the present invention readily lends itself to assisting in this ease of handling. And such is especially desirable as in the case of providing the electrochemically lightweight active coating as this will not thereafter interfere with subsequent electrical resistance welding. Thus, the coating operation of the present invention can be utilized following coiled mesh production whereby the resulting coated article can not only proceed to subsequent processing operation, but will also lend itself to ready manual handling in such operation.

The following example shows a way in which the invention has been practiced but should not be construed as limiting the invention.

EXAMPLE

An imperforate coil of Grade I titanium 114 centimeters (cm) wide × 1.69 meters (m) long × 0.635 millimeter (mm) thick, and having an elongation at 68° C. of 24 percent (for a 2-inch (5 cm.) sheet greater than 0.025 inch (0.0635 cm.) thick), was expanded to a diamond pattern. The dies doing the piercing of the sheet also acted as forming dies to expand the punched slits into the diamond-shaped openings. The process employed a punch with a full indexing to one side to complete the design. Each unit diamond of the pattern measured 7.62 cm LWD × 3.38 cm SWD. Expansion factor was 27 to 1, e.g., the test sheet 1.69 m long was expanded during the patterning to approximately 45.7 m, providing a void fraction of 96 percent. The final strand dimension was 0.635 mm × 0.736 mm. Expansion was at a rate of 220 strokes per minute with no broken strands. The finished expanded titanium had a weight of 0.12 kilogram (Kg) per square meter ($m^2$) of the resulting mesh and an actual metal surface area (strands plus nodes) of 0.16 $m^2$ per square meter of the resulting mesh.

The expanded metal coming through the expansion apparatus was easily coiled into a roll. The resulting roll had an approximately 30 cm diameter interior hollow zone and an overall outside diameter of about 40 cm. The weight of the roll was approximately 11.8 kilos. Titanium metal tie wires were used to prevent the roll from uncoiling in further operation. A support rod was passed through the central hollow zone of the roll and the rod extended beyond the roll at each end whereby lines attached to each end from overhead were used with lifting apparatus. By means of this support rod assembly the roll was then lowered into a degreasing machine containing boiling perchloroethylene solvent. The roll was retained in the overhead vapor zone for about 20 minutes. Thereafter, again by use of the support rod assembly, the degreased coil was immersed for 10 minutes in an aqueous solution of 20 weight percent hydrochloric acid, which solution was maintained at 95° C. Following this etching operation the coil was removed from the etching solution, water rinsed for about 15 minutes followed by steam drying for about 20 minutes.

Again by way of the support rod assembly, the coil was then dipped into a bath of coating solution for providing an electrochemically active coating on the coil. Coating solutions such as the one of this bath fall under the U.S. Pat. No. 3,632,498, example 1. Since this depth of coating solution was less than the diameter of the coil, the coil was slowly rotated to expose the entire coil to the coating solution. Furthermore, the coil was lifted from the solution, rotated slightly around the support rod, redipped into the coating solution and rerolled through the solution. Upon final removal from the coating solution, the coil was agitated by a light manual shaking and then was retained over the tank of coating solution for approximately 30 minutes to permit solution that has been temporarily retained in corners of the diamond-shaped units to drain, as well as to permit the coil to dry.

The dried coil was maintained on its support rod apparatus and by means of this support was then introduced to a conveyor oven. The coil proceeded through the oven in a time of 4 minutes whereby the wire mesh facing the hollow central zone of the coil attained a temperature of approximately 500° C. Upon removal from the oven, the coil was reconveyed for a second 4 minute pass through the oven. After the second pass, the coil is permitted to cool. It was then subsequently uncoiled and found to contain no broken strands or adjacent strands stuck together by such coating and curing operation, and thus was easily and completely uncoiled.

In analysis of coils coated in this manner, wherein the coils have been uncoiled and test pieces cut out for analysis, the coating has been found to provide mixed oxides of titanium and ruthenium in which the ruthenium content is 0.35 gram per square meter. Furthermore, such coating has been found to be sufficiently distributed throughout the mesh that all randomly selected areas for analysis demonstrate desirable coating content. Anodes prepared from such randomly selected samples and subjected to accelerated life testing have all demonstrated enhanced performance sufficient for these mesh anodes to serve in cathodic protection, such as protection of steel reinforced concrete. The coating and curing process using the mesh in coiled form, is thus judged to be highly desirable for supplying coated mesh which will be serviceable as such anodes.

As illustrative of meshes which can be or have been used successfully in the method of the present invention, there are presented the following:

| Mesh Specifications | |
|---|---|
| **Type 1 Mesh** | |
| Composition | Titanium Grade 1 |
| Width of Roll | 45 inches (112.5 cm) |
| Length | 250 to 500 ft. (75 to 150 m) |
| Weight | 26 lbs./1000 ft.$^2$ (11.7 kg/100 m$^2$) |
| Diamond Dimension | 3" LWD × 1⅓" SWD (7.6 cm LWD × 3.3 cm SWD) |
| Resistance Lengthwise (45 inch/112.5 cm wide) | .026 ohm/ft. (0.086 ohm/m) |
| Resistance Widthwise with Current Distributor | .007 ohm/ft. (0.02 ohm/m) |
| Bending Radius | 3/32 inches (0.24 cm) |
| Bending Radius in Mesh Plane | 50 ft. (15 m) |
| **Type 2 Mesh** | |
| Composition | Titanium Grade 1 |
| Width of Roll | 4 ft. (122 cm) |
| Length | 250 to 500 ft. (75 to 150 m) |
| Weight | 45 lbs./1000 ft.$^2$ (20.2 kg/100 m$^2$) |
| Diamond Dimension | 3" LWD × 1⅓" SWD (7.6 cm LWD × 3.3 cm SWD) |
| Resistance Lengthwise (4 ft., 122 cm wide) | .014 ohm/ft. |
| Resistance Widthwise with Current Distributor | .005 ohm/ft. (0.016 ohm/m) |
| Bending Radius | 3/32 inches (0.24 cm) |
| Bending Radius in Mesh Plane | 50 ft. (15 m) |

When the coated metal mesh is used for cathodic protection, such as for retarding corrosion in steel reinforced concrete, the mesh will be connected to a current distribution member. Such a member will most always be a valve metal and preferably is the same metal alloy or intermetallic mixture as the metal most predominantly found in the expanded valve metal mesh. This current distribution member must be firmly affixed to the metal mesh. One preferred manner of firmly fixing the member to the mesh is by welding, e.g., electrical resistance welding such as spot welding. Moreover, the welding can proceed through the coating. Thus, a coated current distributor strip can be laid on a coated mesh, with coated faces in contact, and yet the welding can readily proceed. The strip can be spot welded to the mesh at every node and thereby provide uniform distribution of current thereto. Such a current distributor strip member positioned along a piece of mesh about every 30 meters will usually be sufficient to serve as a current distributor for such piece.

We claim:

1. A method of manufacturing an electrode for electrochemical processes, of the type comprising a valve metal mesh provided with a pattern of substantially diamond shaped voids having LWD and SWD dimensions for units of the pattern, the pattern of voids being defined by a continuum of thin valve metal strands interconnected at nodes and carrying on their surface an electrocatalytic coating, comprising:

(a) providing a flexible, coiled valve metal mesh of thickness less than 0.125 cm having a void fraction of at least 80 percent, said mesh being elongated along the direction of the SWD dimension of the pattern and being coiled about an axis along the direction of the LWD dimension of the pattern, and (b) applying an electrocatalytic coating to the surface of the valve metal mesh while same is coiled to provide a flexible coated mesh electrode in coiled configuration, the mesh being uncoilable from the coiled configuration for use as an electrode.

2. The method of claim 1 wherein said coiled mesh is contacted with liquid coating composition providing an electrocatalytic coating having a coating weight of less than about 0.5 gram of platinum group metal per square meter of the metal mesh substrate.

3. The method of claim 1 wherein said coating is applied by dipping the mesh into coating composition.

4. The method of claim 3 wherein said coiled mesh is rotated while dipped into coating composition.

5. The method of claim 1 wherein said coiled mesh has an at least 90 percent void fraction.

6. The method of claim 1 wherein said coiled metal mesh is pretreated while in coiled form prior to contacting with coating composition.

7. The method of claim 6 wherein said pretreatment includes degreasing of the mesh with degreasing solvent while said mesh is in coiled form.

8. The method of claim 6 wherein said pretreatment includes etching of the mesh while said mesh is in coiled form.

9. The method of claim 1 wherein said coiled mesh is coiled from expanded metal mesh obtained by expanding a sheet or coil of solid metal by an expansion factor of at least 10:1.

10. The method of manufacturing an electrode according to claim 1, which further comprises uncoiling the metal mesh electrode from the coiled configuration and welding a valve metal current distributor member to the uncoiled metal mesh electrode.

11. The method of claim 10, wherein the valve metal current distributor member carries an electrocatalytic coating on its surface, and at least one coated surface of the distributor member is welded to the coated surface of the valve metal mesh at points of connection of the valve metal mesh electrode strands.

12. The method of claim 10, wherein the current distributor member is a strip extending along the direction of the LWD direction of the metal mesh electrode pattern.

13. The method of preparing a fabricated assembly of metal members wherein at least one of said members is a coiled metal mesh of at least 80 percent void fraction, which metal mesh has been expanded from a sheet or coil of said metal to provide a continuum of thin metal strands interconnected at nodes and forming a repeating pattern in said mesh, and which mesh is provided with a heat-curable, lightweight coating, which method comprises:

maintaining said mesh in coiled form while contacting same with liquid coating composition for preparing said coating thereon;

continuing maintenance of said mesh in coiled form while curing said coating composition on said mesh;

contacting the resulting coated mesh with additional metal members for said assembly; and resistance welding said additional metal members to said coated mesh.

14. The method of facilitating the manual handling ease of a greatly expanded, coiled metal mesh of at least 80 percent void fraction, which metal mesh has been expanded from a sheet or coil of said metal to provide a continuum of thin metal strands interconnected at nodes and forming a repeating pattern in said mesh, and which mesh is provided with a heat-curable, lightweight coating, which method comprises:

contacting said mesh while in coiled form with sufficient liquid coating composition for preparing a lightweight heat-curable coating thereon having a coating weight of at least about 0.05 gram per square meter of the metal mesh substrate; and continuing maintenance of said mesh in coiled form while curing said coating composition on said mesh;

thereby preparing a coated mesh of enhanced handling ease.

15. The method of claim 14, wherein said coiled metal mesh is contacted with said composition providing an electrochemically active coating having a coating weight of less than about 1 gram per square meter of the metal mesh substrate.

16. The method of claim 14, wherein said coiled metal mesh is contacted with said composition by dipping the mesh into the composition.

* * * * *